US011633838B1

(12) United States Patent
Mundy et al.

(10) Patent No.: US 11,633,838 B1
(45) Date of Patent: Apr. 25, 2023

(54) GEAR PULLER HAVING IMPROVED PULLER ARMS FOR STABILITY IN OPERATION THEREOF

(71) Applicant: Horizon Tool, Inc., Greensboro, NC (US)

(72) Inventors: Joseph R. Mundy, Greensboro, NC (US); Ian M. Wirick, Greensboro, NC (US); Christopher R. Simpson, Greensboro, NC (US)

(73) Assignee: HORIZON TOOL, INC., Greensboro, NC (US)

( * ) Notice: Subject to any disclaimer, the term of this patent is extended or adjusted under 35 U.S.C. 154(b) by 0 days.

(21) Appl. No.: 17/543,838

(22) Filed: Dec. 7, 2021

(51) Int. Cl.
*B25B 27/00* (2006.01)
*B25B 27/02* (2006.01)

(52) U.S. Cl.
CPC ..... *B25B 27/023* (2013.01)

(58) Field of Classification Search
CPC ..... B25B 27/00; B25B 27/0028; B25B 27/12; B25B 27/24; B23P 19/00; B23P 19/027
USPC ..... 29/256, 261, 263, 259
See application file for complete search history.

(56) References Cited

U.S. PATENT DOCUMENTS 1,715,506 A * 6/1929 Livesay ..... B25B 27/023 29/261
2,956,336 A * 10/1960 Peterson ..... B61G 9/20 29/261
10,704,421 B2 * 7/2020 Mogle, II ..... B25B 27/062
2010/0115748 A1 * 5/2010 Lin ..... B25B 27/023 29/259
2012/0102704 A1 * 5/2012 Barrios ..... B25B 27/023 29/256

* cited by examiner

*Primary Examiner* — Lee D Wilson
*Assistant Examiner* — Tyler James McFarland
(74) *Attorney, Agent, or Firm* — NK Patent Law

(57) ABSTRACT

A gear puller assembly includes a yoke that defines a plurality of puller arm receiving interfaces, a threaded jack shaft threadably received through the yoke and having a pressing surface on an end thereof, and a plurality of puller arms, wherein each respective puller arm is configured for being selectively engageable with a respective puller arm interface of the yoke. A detent assembly extends from the yoke through each of the puller arm receiving interfaces, each of the detent assemblies configured for engagement with respective puller arms to cause the puller arm to maintain a locked position defined at an angle between the respective puller arms and the yoke.

14 Claims, 4 Drawing Sheets

GEAR PULLER HAVING IMPROVED PULLER ARMS FOR STABILITY IN OPERATION THEREOF

TECHNICAL FIELD

The invention herein pertains to a gear puller. The gear puller may be used for pulling one or more gear, wheel, hub, or similar assemblies from an elongated shaft.

BACKGROUND

Tools for removing gears, fly wheels, bearings, hubs and the like from their associated shaft have been used for many years, and these tools usually basically consist of a yoke or bridge member having a threaded jack shaft extending through the central region thereof. Pulling implements or work engaging elements are mounted upon the yoke or bridge, and include shoulders or surfaces usually adapted to be located behind the wheel or gear to be pulled while the threaded jack shaft engages the end of the shaft on which the wheel or gear is mounted. Rotation of the jack shaft causes the pulling implements to draw the wheel or gear toward the jack shaft for removal from the shaft.

A number of types of construction have been utilized with this type of tool for mounting the pulling implement upon the yoke or bridge. The most common arrangement is to pivotally connect the pulling implements to the yoke by pivots and link wherein a single size of puller tool may accommodate a number of sizes of gears or wheels. Most puller tools are readily adaptable for use with different sizes of gears or wheels, within the limits of capacity of the tool, and in the design of the tool, to permit its universal use with different sizes of wheels or gears, the provision of links and pivots in the pulling implements produces compromises in the design which-often affect the operation of the tool. For instance, the limited radial adjustment of which most puller tools are capable of with respect to the mounting of the puller implement upon the yoke usually results in the tension forces created in the pulling implements not being parallel to the compression force present in the jack shaft. Due to the forces within the jack shaft and the pulling implement not being parallel difficulty is often encountered in maintaining engagement of the implement and the wheel or gear being pulled, resulting in the puller losing its grip upon the wheel or gear and necessitating readjustment a reassembly of the tool upon the wheel being pulled. It is not uncommon for the mounting of the puller on the gear to have to be repeated several times before the wheel or gear is sufficiently axially displaced upon its shaft to permit removal.

Also, conventional puller tools, particularly those employing linkages in the pulling implement, are difficult to assemble to the wheel or gear to be pulled. Proper assembly to the member to be pulled requires that the jack shaft be properly axially positioned with respect to the yoke such that the pulling implements are capable or engaging the back surface of the wheel or gear. Thus, it is necessary to place the tool upon the wheel or gear while holding the pulling implements in engagement therewith, and simultaneously rotate the jack shaft until sufficient forces are produced in the tool for it to hold itself in position. During this procedure it is important that the yoke be properly related to the wheel, usually in a diametrical relationship, so that the pull exerted on the wheel will not tend to pull the same, but will be parallel to the wheel shaft. Accordingly, considerable skill and dexterity is required in using a wheel or gear pulling tool of conventional construction.

Accordingly, improvements are needed in the gear space to address these issues.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to one or more embodiments, a gear puller assembly includes a yoke that defines a plurality of puller arm receiving interfaces, a threaded jack shaft threadably received through the yoke and having a pressing surface on an end thereof, and a plurality of puller arms. Each respective puller arm is configured for being selectively engageable with a respective puller arm interface of the yoke. A detent assembly extends from the yoke through each of the puller arm receiving interfaces. Each of the detent assemblies is configured for engagement with respective puller arms to cause the puller arm to maintain a locked position defined at an angle between the respective puller arms and the yoke.

According to one or more embodiments, each respective puller arm defines a plurality of ridges that are configured to engage with a respective detent assembly to selectively maintain the respective puller arm in a desired angular position.

According to one or more embodiments, each detent assembly is biased outwardly.

According to one or more embodiments, each respective puller arm defines a shoulder that extends outwardly. The shoulder is configured for being received within a recess defined within the yoke to selectively engage the respective puller arm with a respective recess within the yoke.

According to one or more embodiments, the shoulder defines a first cross-dimension that is smaller than a second cross-dimension. Rotation of the puller arm such that the shoulder first cross-dimension is aligned with a slot defined in the yoke allows for the selective engagement of the puller arm with the yoke.

According to one or more embodiments, the threaded jack shaft has a hexagonal head for receiving rotational forces from a tool to rotate the threaded jack shaft to elongate or shorten the jack shaft relative to the yoke.

According to one or more embodiments, the puller arms define a tang that extends radially inwardly.

According to one or more embodiments, the puller arms define a tang that extends circumferentially.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
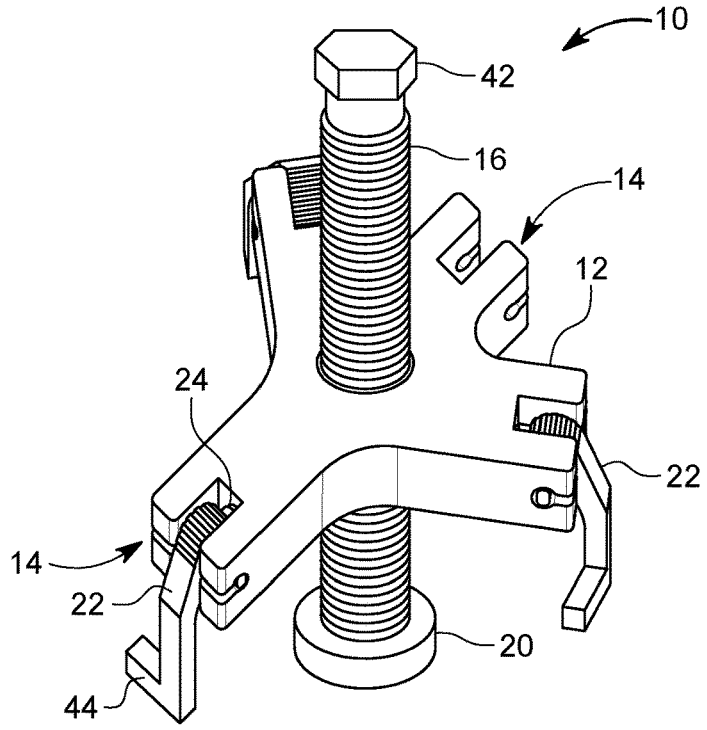
FIG. 1 illustrate a perspective view of a gear puller according to one or more embodiments.

These descriptions are present particular embodiments with sufficient details to provide an understanding of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless described or implied as exclusive alternatives, features throughout the drawings and descriptions should be taken as cumulative, such that features expressly associated with some particular embodiments can be combined with other embodiments.

Figure 3:
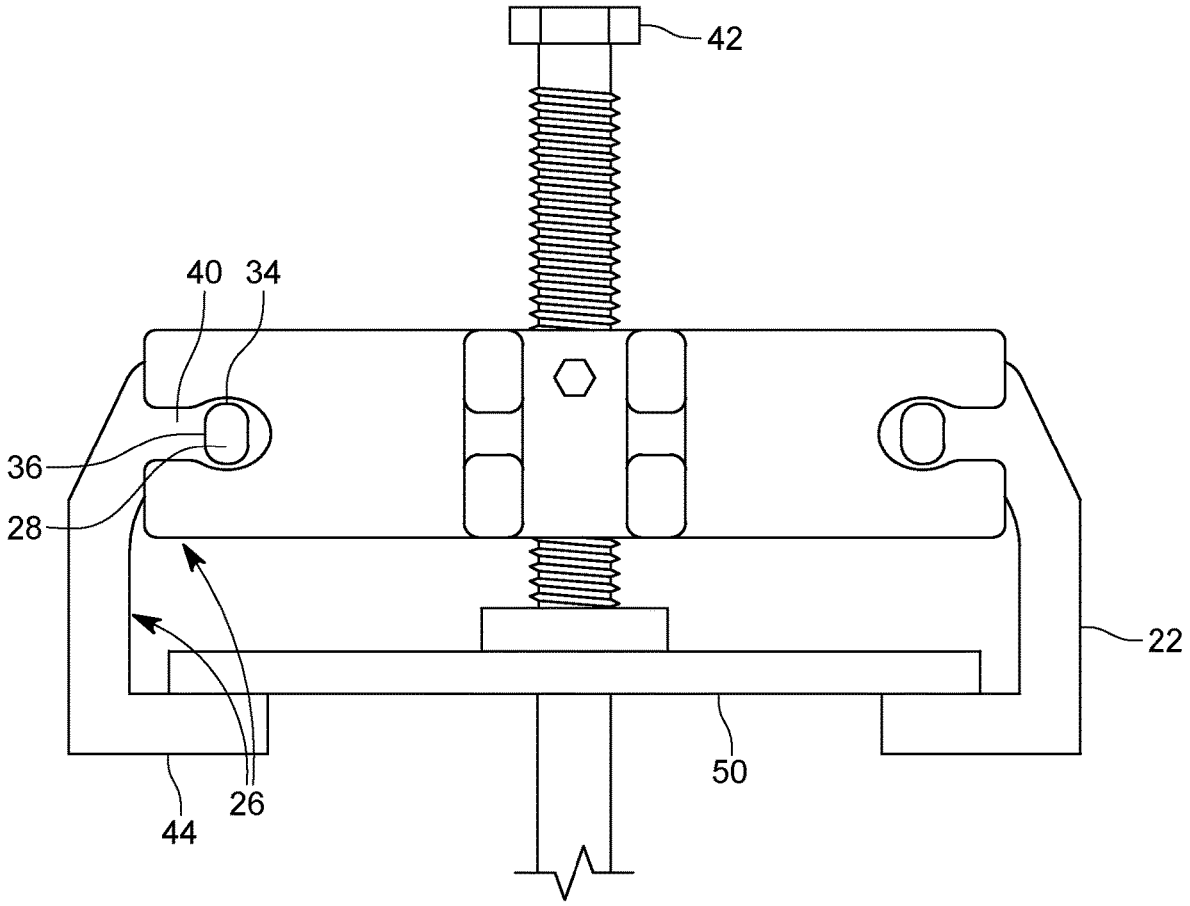
FIG. 3 illustrates a cross-sectional, side view of a gear puller according to one or more embodiments.
Figure 4:
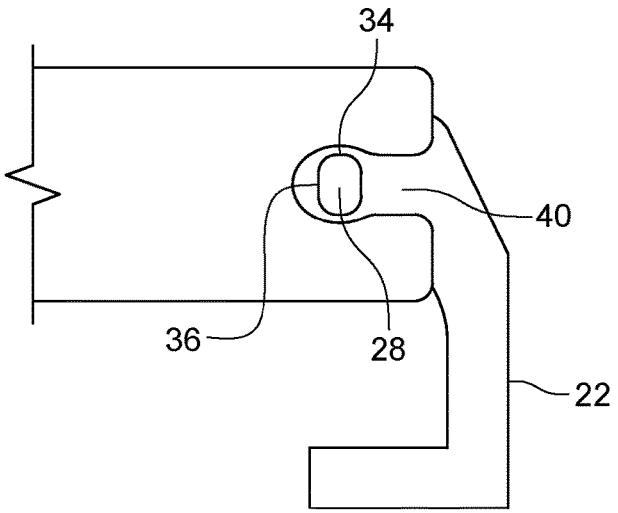
FIG. 4 illustrates a partial, side view of a gear puller according to one or more embodiments.
Figure 5:
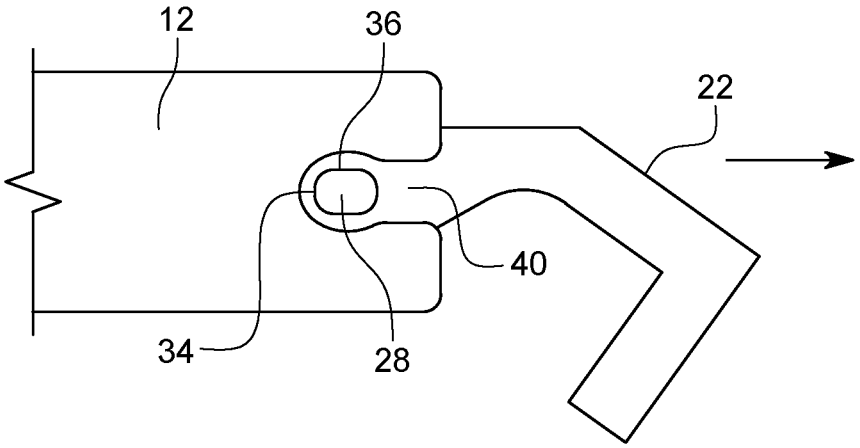
FIG. 5 illustrates a first sequential side view of removal of a puller arm from the gear puller yoke according to one or more embodiments.
Figure 6:
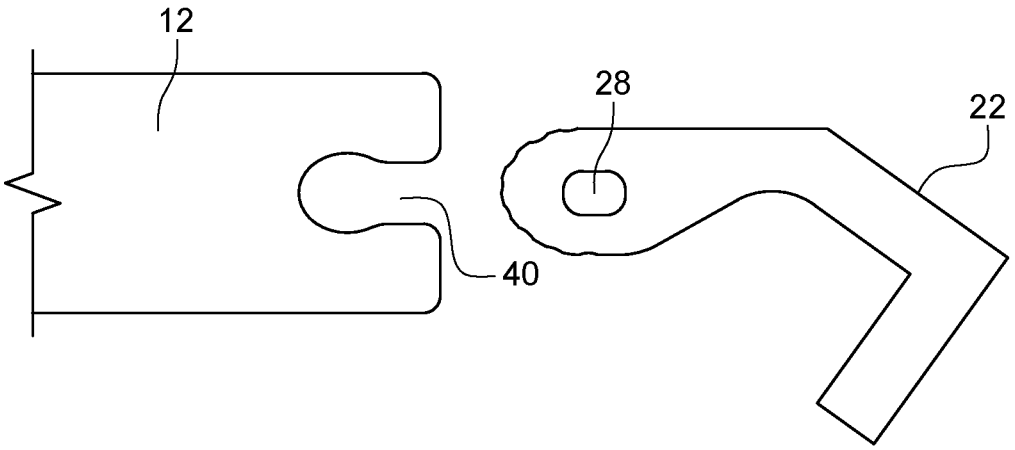
FIG. 6 illustrates a second sequential side view of removal of a puller arm from the gear puller yoke according to one or more embodiments.

FIG. 1 illustrates a gear puller assembly that is generally designated 10 throughout the drawings. The puller assembly 10 includes a yoke 12 that defines a plurality of puller arm receiving interfaces 14. A threaded jack shaft 16 is threadably received through the yoke and has a pressing surface 20 on an end thereof. A plurality of puller arms 22 are provided, each respective puller arm 22 is configured for being selectively engageable with a respective puller arm interface 14 of the yoke 12. A detent assembly 24 extends from the yoke through each of the puller arm receiving interfaces 14. Each of the detent assemblies 24 is configured for engagement with respective puller arms 22 to cause the puller arm 22 to maintain a locked position defined at an angle (see angle 26 in FIG. 3) between the respective puller arms 22 and the yoke 12.

The yoke 12 is illustrated having four arm receiving interfaces 14, which allows each the user to select between a three arm puller arrangement (as illustrated in FIG. 1) or a two arm arrangement (where a puller arm 22 is removed entirely, and another puller arm 22 is positioned in the unused arm receiving interface shown in FIG. 1). The yoke 12 though can have any appropriately numbered amount of interfaces 14. Furthermore, as will be discussed herein, the yoke 12 is configured for very efficient removal and addition of puller arms 22 to provide for a different number or different construction of puller arms 22, however, the removability aspect is not required within the design. The threaded jack shaft 16 may further include a hexagonal or other fastening head to allow rotation thereof as is known in the art. The pressing surface 20 may be selectively engageable with the jack shaft 16 to allow removal of the pressing surface to thereby change out the threaded jack shaft 16, or to employ a differently shaped or configured pressing surface 20.

Figure 7:
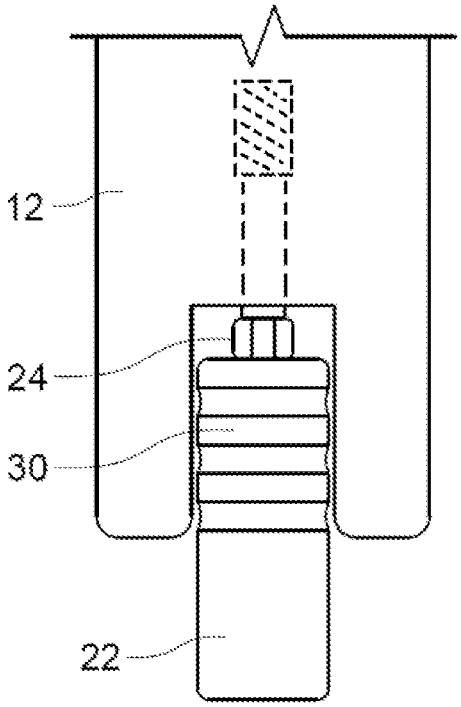
FIG. 7 illustrates an overhead view of the puller arm being engaged with a detent assembly to selectively maintain the puller arms in a desired angular position according to one or more embodiments.

As illustrated with further reference to FIG. 1 and FIG. 7, each respective puller arm 22 defines a plurality of ridges 30 that are configured to engage with a respective detent assembly 24 to selectively maintain the respective puller arm 22 in a desired angular position. The detent assembly 24 is broadly defined as any structure that is configured for imparting sufficient forces upon puller arm 22 to be able to maintain puller arm 22 in the desired angular position. It is illustrated in the drawings, with particular reference to FIG. 7 as a plunger assembly that is biased outwardly and configured for engaging within ridges 30. Ridges 30 are spaced-apart a sufficient amount to allow for incremental changes in the angular position.

The detent assembly 24 may be a plunger that is biased outwardly by a spring or other biasing member maintained in the yoke 12. Alternatively, detent assembly 24 may be a leaf spring, a Delrin® or similar type of fixed structure, or any other suitable structure.

The puller 10 conventional makes an audible click noise each time the puller arm 22 is rotated due to the engagement of the detent assembly 24 with the ridges 30. In this manner, the audible click noise alerts the user to movement of the puller arms 22.

Figure 2:
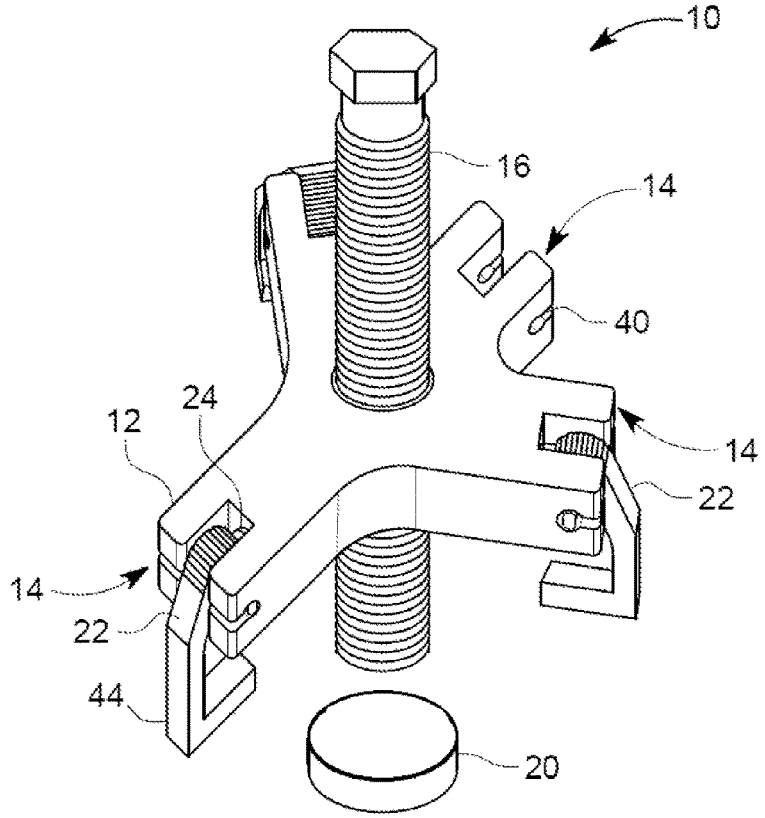
FIG. 2 illustrate a perspective view of a gear puller according to one or more embodiments.

As illustrated, the puller arms each have a tang 44 that extends circumferentially as illustrated in FIG. 1 or may extend radially as illustrated in FIG. 2. The puller arms 22 may be longer or shorter, and have tangs that are longer or shorter. Any appropriate configuration may be employed.

As well illustrated with reference to FIGS. 3 through 6, each respective puller arm 22 defines a shoulder 28 that extends outwardly. The shoulder 28 is configured for being received within a recess 40 defined within the yoke 12 to selectively engage the respective puller arm 22 with a respective recess 40 within the yoke 12. This is accomplished by any appropriate number of ways. In one embodiment illustrated in the drawings, the shoulder 28 is chamfered or otherwise machined or formed such that a first cross-dimension 36 that is smaller than a second cross-dimension 34. In this manner, rotation of the puller arm 22 will position the shoulder 28 such that the first cross-dimension 36 is aligned with slot 40 defined in the yoke 12 to allow for the selective engagement of the puller arm 22 with the yoke 12 by then translating puller arm 22 away from the yoke 12. This is illustrated sequentially in FIGS. 5 and 6. Insertion of a puller arm 22 back into the yoke 12, and then subsequent downward rotation of the puller arm 22 then locks the puller arm 22 back within the yoke 12 for subsequent use.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed:

1. A gear puller assembly comprising:

a yoke that defines a plurality of puller arm receiving interfaces and a plurality of interior passages extending radially into the yoke from each of the of puller arm [receiving interfaces] assemblies;

a threaded jack shaft threadably received through the yoke and having a pressing surface on an end thereof;

a plurality of puller arms, wherein each respective puller arm is configured for being selectively engageable with a respective puller arm interface of the yoke;

wherein a detent assembly extends from an interior portion of the yoke through at least a portion of one of the plurality of interior passages into each of the puller arm receiving interfaces, each of the detent assemblies configured for engagement with respective puller arms to cause the puller arm to maintain a locked position defined at an angle between the respective puller arms and the yoke.

2. The puller assembly of claim 1, wherein each respective puller arm defines a plurality of ridges that are configured to engage with a respective detent assembly to selectively maintain the respective puller arm in a desired angular position.

3. The puller assembly of claim 2, wherein engagement of the detent assembly from a ridge of the plurality of ridges to an adjacent ridge during rotation of the puller arm imparts an audible signal indicative of rotation of the puller arm.

4. The puller assembly of claim 1, wherein each detent assembly is biased outwardly.

5. The puller assembly of claim 1, wherein each respective puller arm defines a shoulder that extends outwardly, the shoulder configured for being received within a recess defined within the yoke to selectively engage the respective puller arm with a respective recess within the yoke.

6. The puller assembly of claim 5, wherein the shoulder defines a first cross-dimension that is smaller than a second cross-dimension, wherein rotation of the puller arm such that the shoulder first cross-dimension is aligned with a slot defined in the yoke allows for the selective engagement of the puller arm with the yoke.

7. The puller assembly of claim 6, wherein the slot in the yoke is contiguous with a circular shaped opening in the yoke, the circular shaped opening having a dimension that allows for rotation of the shoulder therein.

8. The puller assembly of claim 1, wherein the threaded jack shaft has a hexagonal head for receiving rotational forces from a tool to rotate the threaded jack shaft to elongate or shorten the jack shaft relative to the yoke.

9. The puller assembly of claim 1, wherein the puller arms define a tang that extends radially inwardly.

10. The puller assembly of claim 1, wherein the puller arms define a tang that extends circumferentially.

11. The puller assembly of claim 1, wherein the pressing surface of the threaded jack shaft is removably connected to the threaded jack shaft.

12. A gear puller assembly comprising:

a yoke that defines a plurality of puller arm receiving interfaces and a plurality of interior passages extending radially into the yoke from each of the of puller arm receiving interfaces;

a threaded jack shaft threadably received through the yoke and having a pressing surface on an end thereof;

a plurality of puller arms, wherein each respective puller arm is configured for being selectively engageable with a respective puller arm interface of the yoke;

wherein a detent assembly extends from an interior portion of the yoke through at least a portion of one of the plurality of interior passages into each of the puller arm receiving interfaces, each of the detent assemblies configured for engagement with respective puller arms to cause the puller arm to maintain a locked position defined at an angle between the respective puller arms and the yoke, wherein each respective puller arm defines a plurality of ridges that are configured to engage with a respective detent assembly to selectively maintain the respective puller arm in a desired angular position, wherein engagement of the detent assembly from a ridge of the plurality of ridges to an adjacent ridge during rotation of the puller arm imparts an audible signal indicative of rotation of the puller arm, wherein each respective puller arm defines a shoulder that extends outwardly, the shoulder configured for being received within a recess defined within the yoke to selectively engage the respective puller arm with a respective recess within the yoke, wherein the shoulder defines a first cross-dimension that is smaller than a second cross-dimension, wherein rotation of the puller arm such that the shoulder first cross-dimension is aligned with a slot defined in the yoke allows for selective dis-engagement of the puller arm with the yoke.

13. The puller assembly of claim 12, wherein each detent assembly is biased with a spring maintained within one of the plurality of interior passages of the yoke.

14. The puller assembly of claim 4, wherein each detent assembly is biased with a spring maintained within one of the plurality of interior passages of the yoke.

* * * * *